United States Patent [19]

Weiler

[11] 4,264,272

[45] Apr. 28, 1981

[54] GAS TURBINE ENGINE

[75] Inventor: Wolfgang Weiler, Dachau, Fed. Rep. of Germany

[73] Assignee: Motoren-und Turbinen-Union Munchen GmbH, Munich, Fed. Rep. of Germany

[21] Appl. No.: 941,411

[22] Filed: Sep. 11, 1978

[30] Foreign Application Priority Data

Sep. 13, 1977 [DE] Fed. Rep. of Germany ..... 2741063

[51] Int. Cl.[3] ..... F01D 5/08; F01D 25/16

[52] U.S. Cl. ..... 415/175; 415/211

[58] Field of Search ..... 60/39.08, 39.36; 415/175, 207, 208, 209, 210, 211

[56] References Cited

U.S. PATENT DOCUMENTS

| | | | |
|---|---|---|---|
| 2,791,090 | 5/1957 | Hooker | 60/39.08 |
| 3,019,606 | 2/1962 | Franz | 60/39.36 |
| 3,084,849 | 4/1963 | Dennison | 415/175 |
| 4,147,026 | 4/1979 | Weiler | 60/39.08 |

FOREIGN PATENT DOCUMENTS

| | | | |
|---|---|---|---|
| 2405741 | 8/1975 | Fed. Rep. of Germany | 60/39.08 |

*Primary Examiner*—Robert E. Garrett

*Attorney, Agent, or Firm*—Haseltine and Lake

[57] ABSTRACT

A gas turbine engine in which a centrifugal diffusor is located downstream of a centrifugal compressor. The compressor air flow from the centrifugal diffusor is deflected into an axial direction by a substantially 90 degree elbow. The air flow is further decelerated in an axial-flow stator cascade upstream of the combustion chamber. A main bearing of the gas generator is arranged immediately downstream of the centrifugal compressor. This bearing is supplied from the outside through vanes of the axial-flow stator cascade. The axial-flow stator cascade is divided into groups of vanes, so that each group had a number of relatively small guide vanes and one relatively large guide vane. The small guide vanes are designed from the view point of fluid mechanics consideration, while the larger guide vane of a group is hollow for supplying the bearing. The large guide vane has a substantially longer and a substantially thicker vane profile than the small vanes. Slow ducts are provided between the small vanes on the one hand, and between each small guide vane and a large guide vane on the other hand. The flow ducts are substantially of identical geometric dimensions. The large vane and small guide vanes within the cascade assembly may be arranged so that half the relative length of profile of all vanes extend in substantially one plane.

10 Claims, 3 Drawing Figures

1
2
4
9
10
11
16
17
22
22'
24
27

GAS TURBINE ENGINE

BACKGROUND OF THE INVENTION

This invention relates to a gas turbine engine having a centrifugal compressor and immediately downstream of it a centrifugal diffusor from which the compressor air flow is deflected into an axial direction via a substantially 90 degree elbow and is further decelerated in an axial-flow stator cascade arranged upstream of the combustion chamber. Arranged immediately downstream of the centrifugal compressor, is a main bearing of the gas generator. This main bearing is supplied from the outside through the vanes of the axial-flow stator cascade.

Highly-stressed centrifugal compressors, especially centrifugal compressors of gas turbine engines, are normally fitted with two stators for maximum conversion of the dynamic pressure downstream of the impeller into static pressure by deceleration of the flow. Following a first centrifugal stator cascade often fitted with wedge-shaped vanes, the flow is deflected, especially with gas turbine engines, through 90° and is then decelerated in a second axial-flow cascade. The airfoil sections used in this second cascade roughly corresponds to those of an outlet stator cascade with highly-stressed axial-flow compressors.

If the general design of the engine calls for a main bearing immediately downstream of the centrifugal compressor—which is often recommended for reasons of efficiency and performance—all bearing supply lines (fresh oil, return oil, sealing air and possibly bearing chamber venting) must necessarily be routed through the flow duct. When this is the case it is generally impossible to route these supply lines through the radially wetted portion of the stator with its thin, wedge-shaped vanes. When the bearing is supplied through freely exposed lines running through the flow duct downstream of the axial-flow stator cascade, these will cause irregular flow, normally to the great detriment of component assemblies downstream of the compressor, as perhaps the combustion chamber of a gas turbine engine. When the bearing is supplied through the vanes of the axial-flow portion of the stator, the form of the airfoil sections of the cascade is generally less than ideal. This is aggravated by the fact that it invariably takes a group of blades to serve any one function, as e.g. for draining the oil, because each cascade section has only little free cross-sectional area available. At the same time there is an unfavorable ratio of circumference to cross-sectional area of the partial ducts, which is a considerable disadvantage especially for the oil ducts (high heat transfer, oil heating). This compels considerable complexity of design when splitting the various streams into a number of partial streams. This effort is duplicated when the various partial streams are subsequently gathered into the respective main stream.

A broad object of the present invention is to improve conventional gas turbine engines of this generic category such that the main bearing downstream of the centrifugal compressor is optimally supplied while ensuring proper aerodynamic conditions for the axia-flow stator cascade.

Another object of the present invention is to provide an improved gas turbine engine of the foregoing character, which is substantially simple in construction and may be economically fabricated.

A further object of the present invention is to provided an arrangement, as described, which has a substantially long operating life.

SUMMARY OF THE INVENTION

The objects of the present invention are achieved by providing an arrangement where the axial-flow stator cascade is split into groups of vanes each consisting of a number of relatively small guide vanes and one relatively large guide vane. The small vanes are designed strictly from the mechanics of fluids aspect and the large vane of the group are hollow to supply the bearing and have a much longer profile as well as a substantially greater absolute thickness of profile. The flow ducts between the small vanes, on the one hand, and between each small vane and a large vane, on the other, exhibit essentially identical geometric dimensions.

In a further embodiment of the present invention the large and the small guide vanes within the stator cascade are arranged such that half of the relative length of profile of all vanes extends approximately in one plane.

In a still further advantageous embodiment of the present invention the guide vanes of the axial-flow stator cascade are welded or brazed to a double-walled, preferably cast shell serving as a bearing support of the main bearing such that the large guide vane of each group of vanes is fitted exactly above a section of the bearing shell that is formed as a supply duct.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
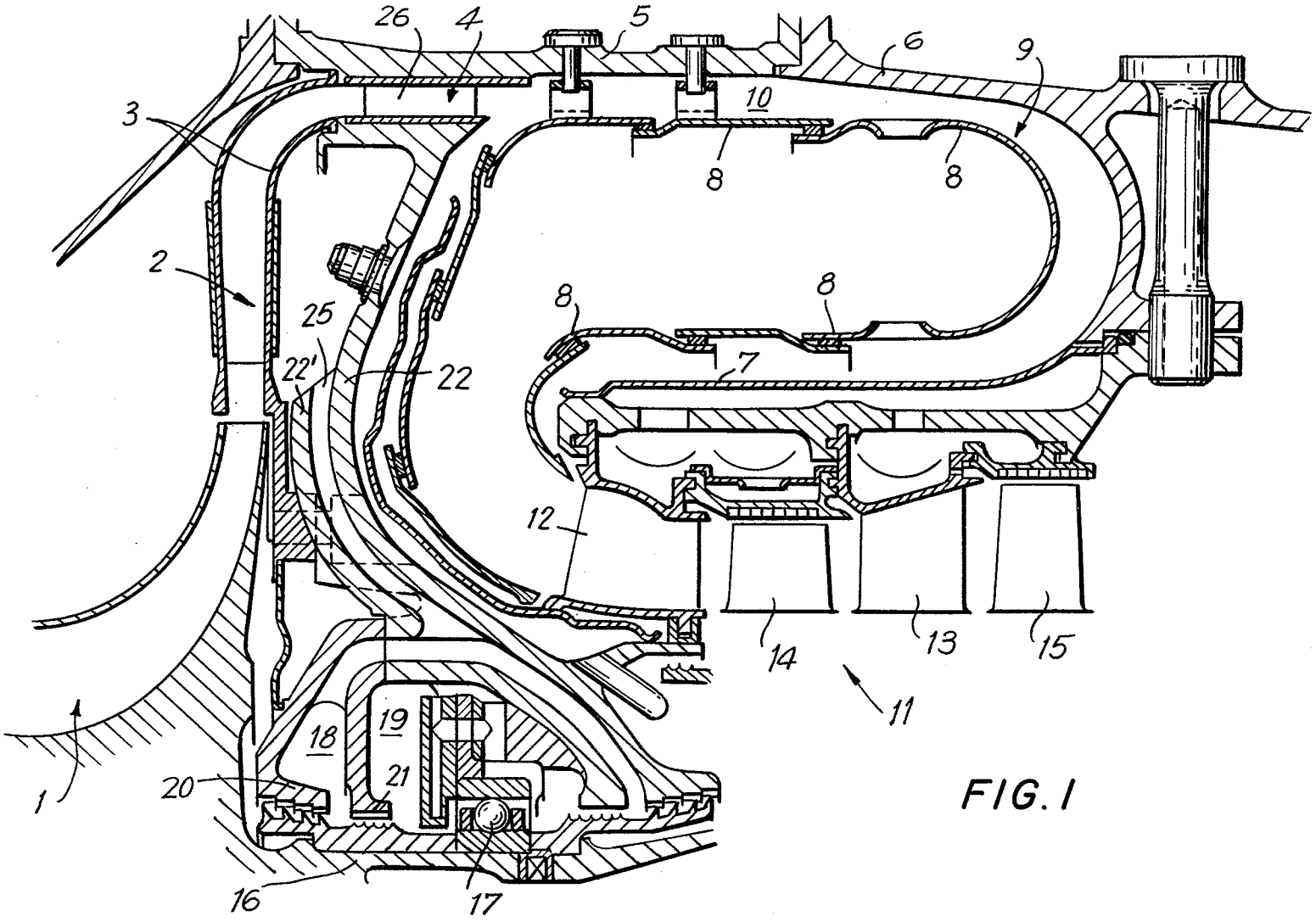
FIG. 1 is a longitudinal section and illustrates engine components arranged above the horizontal center plane of a gas turbine engine.

With reference now to FIG. 1 the gas generator of the gas turbine engine comprises a centrifugal compressor 1 and downstream of it a centrifugal diffusor 2. The compressor air flow from diffusor 2 is deflected into an axial direction by means of a 90 degree elbow 3 and ducted to an axial-flow stator cascade 4 downstream of the elbow 3.

The axial-flow stator cascade 4 issues into an annular duct 10 arranged between outer casing components 5, 6 and 7 and the flame tube 8 of a reverse-flow combustion chamber 9, with the annular duct supplying the combustion chamber with combustion, mixing and cooling air.

The guide vane and rotor blade of a drive turbine 11 of the centrifugal compressor 1 are indicated by the numerals 12, 13 and 14, 15, respectively.

The centrifugal compressor 1 and the compressor drive turbine 11 are arranged on a common gas generator shaft 16. The main bearing of the gas generator shaft 16 at the compressor end is indicated by the numeral 17.

As it will further become apparent from FIG. 1, the outer and inner bearing chamber 18, 19 of the main bearing 17, inclusive of the associated seal carriers 20, 21 opposite the gas generator shaft 16 are formed by a double-walled bearing shell 22, 22' which thus serves as a bearing support of main bearing 17. This bearing shell 22, 22'—cf. FIG. 2—is arranged coaxially with the longitudinal centerline 23 of the engine, designed as a rigid box construction to resist endwise forces, and provided with supply ducts 24 (FIG. 2) at the centrifugal compressor end for the supply of the bearing. The supply ducts 24—originating at the longitudinal centerline—may be directed outwardly in stellate or radial arrangement and spaced equally to serve the following exemplary functions: bearing chamber venting, fresh oil supply, return oil discharge.

The supply ducts 24 may be formed by ribs 25 (FIG. 1) associated with one or the other of the two shell members 22 or 22' and simultaneously providing a spacing axially between the shell members 22, 22'.

Considering the above special construction of the gas turbine engine the supply of the main bearing 17 from the outside is effected through the vanes of the axial-flow cascade 4. For this purpose the axial-flow stator cascade 4 is split into groups of vanes each consisting of a number of relatively small guide vanes 26 and one relatively large guide vane 27. The small vanes 26 are designed strictly from the mechanics of fluids aspect while the large vane 27 is made hollow and, compared with the small vanes 26, has a clearly longer vane profile and an essentially greater absolute thickness of profile. In this arrangement the flow ducts between the small vanes 26, on the one hand, and between one each small vane and a large vane 27, on the other, exhibit essentially identical geometric dimensions.

In the interest of aerodynamically favorable conditions, the large vane 27 and the small vanes 26 of this group of vanes are aranged within the stator cascade such that half the relative length of profile of all vanes 26, 27 extends in approximately one plane.

Figure 3:
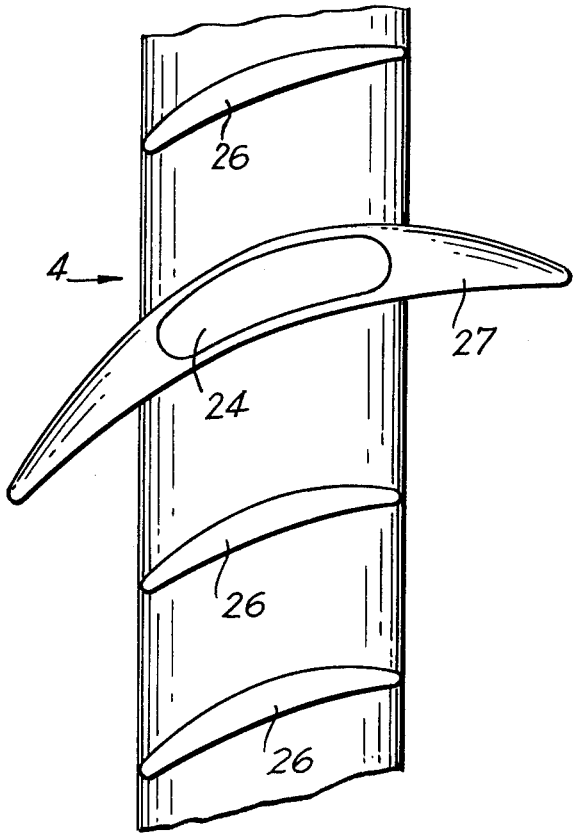
FIG. 3 is a drawing plane projection of a group of vanes of the axial-flow cascade arranged between the centrifugal diffusor and the combustion chamber.

As it will further become apparent from FIG. 3, the small guide vanes 26 and the large guide vane 27 exhibit a common radius of curvature on the pressure side on the one hand and on the suctions side on the other, which applies to all axial planes concerned.

In a further advantageous aspect of the present invention the large and small guide vanes are precision castings.

In a further aspect of the present invention, the small guide vanes are DCA or NACA sections of small thickness-chord ratios, the DCA section being a double circular arc section for subsonic or transonic flows, and the NACA section being section series developed by NACA for mostly subsonic flows.

The guide vanes 26, 27 forming part of the respective groups of vanes of the axial-flow stator cascade 4 are optionally brazed or welded to the members 22, 22' of the bearing shell, thus inseparably joining the two members 22, 22' of the bearing shell.

In the absence of special considerations, such as extremely lightweight construction, the two members 22, 22' can be made as castings with the supply ducts 24 integrated into the castings in the form of, perhaps, cored passages.

Figure 2:
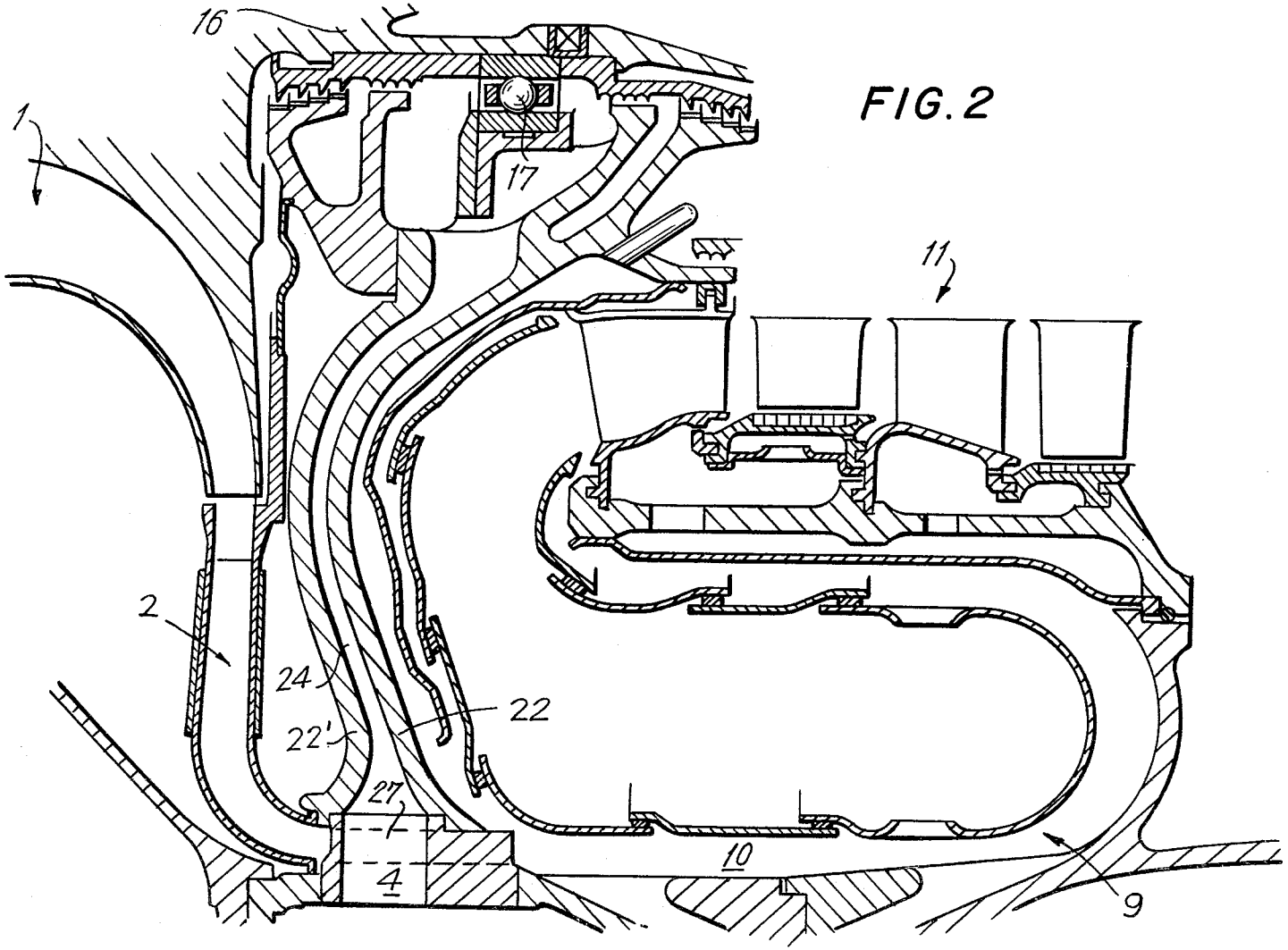
FIG. 2 is a longitudinal section and illustrates engine components arranged below the horizontal center plane of the gas turbine engine of FIG. 1.

Although not shown on the drawings, the centrifugal compressor of FIGS. 1 and 2 may be preceded by a multiple-stage axial-flow compressor driven by a mechanically independent turbine downstream of the compressor drive turbine 11, where the shaft of the second turbine is carried through the interior of the tubular gas generator shaft.

Without further analysis, the foreging will so fully reveal the gist of the present invention that others can, by applying current knowledge, readily adapted for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A gas turbine engine comprising: a centrifugal compressor; a centrifugal diffusor downstream from said centrifugal compressor; elbow means of substantially 90° for deflecting compressor air flow from said centrifugal diffusor into an axial direction; a combustion chamber; an axial-flow stator cascade with vanes upstream of said combustion chamber, said air flow being further decelerated in said axial-flow stator cascade upstream of said combustion chamber; a gas generator with main bearing means arranged immediately downstream of said centrifugal compressor, said bearing means being supplied from outside through said vanes of said axial-flow stator cascade; said axial-flow stator cascade being divided into groups of vanes, each group comprising a plurality of relatively small guide vanes and a relatively large guide vane; said small guide vanes having a structure conforming substantially to fluid mechanics requirements; said large guide vane in each of said groups of vanes being hollow to supply said main bearing means; said large guide vane having a substantially longer and substantially thicker profile than said small vanes; flow ducts between said small vanes, on the one hand, and between said small guide vanes and said large guide vane, on the other hand, having substantially identical geometric dimensions.

2. A gas turbine engine as defined in claim 1, wherein said large vane and said small guide vanes within said cascade are arranged so that half the relative length of profile of all vanes extends in substantially one plane.

3. A gas turbine engine as defined in claim 1 including a double-walled shell for supporting said main bearing means, said large guide vane and said small guide vanes being welded to said double-walled shell, a large guide vane of each group of vanes being fitted over a section of said shell to form a supply duct.

4. A gas turbine engine as defined in claim 3 wherein said double-walled shell comprises a cast shell.

5. A gas turbine as defined in claim 2 including a double-walled shell for supporting said main bearing means, said large guide vane and said small guide vanes of said cascade being welded to said shell, a large guide vane of each group of vanes being fitted over a section of said shell to form a supply duct.

6. A gas turbine engine as defined in claim 5 wherein said double-walled shell comprises a cast shell.

7. A gas turbine engine as defined in claim 1 including a double-walled shell for supporting said main bearing means, said large guide vane and said small guide vanes being brazed to said shell, a large guide vane of each group of vanes being fitted over a section of said shell to form a supply duct.

8. A gas turbine engine as defined in claim 2 including a double-walled shell for supporting said main bearing means, said large guide vane and said small guide vanes of said cascade being brazed to said shell, a large guide vane of each group of vanes being fitted over a section of said bearing shell to form a supply duct.

9. A gas turbine engine as defined in claim 7 wherein said double-walled shell comprises a cast shell.

10. A gas turbine engine as defined in claim 8 wherein said double-walled shell comprises a cast shell.

* * * * *